US005123561A

United States Patent [19]

Gross

[11] Patent Number: 5,123,561

[45] Date of Patent: Jun. 23, 1992

[54] CLOSURE WITH TAMPER-EVIDENT TEAR-OFF PANEL

[76] Inventor: Richard A. Gross, 23 Surrey La., Crystal Lake, Ill. 60014

[21] Appl. No.: 672,638

[22] Filed: Mar. 20, 1991

[51] Int. Cl.[5] ..... B65D 51/18

[52] U.S. Cl. ..... 220/254; 220/266; 220/270; 215/237; 215/251; 215/254; 215/258; 222/23; 222/153; 222/541

[58] Field of Search ..... 215/250, 251, 253, 254, 215/255, 235, 237; 220/254, 266, 270; 222/23, 153, 541, 556

[56] References Cited

U.S. PATENT DOCUMENTS

| | | | |
|---|---|---|---|
| 2,950,834 | 8/1960 | Mazza . | |
| 3,391,847 | 7/1968 | Christine et al. . | |
| 3,419,198 | 12/1968 | Pettersen . | |
| 4,291,818 | 9/1981 | Nozawa et al. . | |
| 4,361,250 | 11/1982 | Foster . | |
| 4,371,088 | 2/1983 | Gach . | |
| 4,397,400 | 8/1983 | Walter . | |
| 4,431,110 | 2/1984 | Roth . | |
| 4,460,100 | 7/1984 | Libit | 215/237 |
| 4,462,504 | 7/1984 | Roth et al. . | |
| 4,467,931 | 8/1984 | Gach . | |
| 4,487,324 | 12/1984 | Ostrowsky . | |
| 4,512,486 | 4/1985 | Kobayashi et al. | 215/305 X |
| 4,595,123 | 6/1986 | Libit | 215/237 X |
| 4,610,371 | 9/1986 | Karkiewicz | 215/237 X |
| 4,711,363 | 12/1987 | Marino | 215/237 X |
| 4,711,372 | 12/1987 | Gach | 215/237 X |
| 4,733,787 | 3/1988 | Knopt et al. | 215/251 |
| 4,736,858 | 4/1988 | Shastal | 215/236 |
| 4,763,801 | 8/1988 | Nycz | 215/235 X |
| 4,775,065 | 10/1988 | Shastal | 215/250 X |
| 4,778,072 | 10/1988 | Newman | 215/237 X |
| 4,892,217 | 1/1990 | Shastal | 220/266 X |
| 4,941,592 | 7/1990 | Kitterman | 215/250 X |
| 4,961,511 | 10/1990 | Piltz | 220/270 |
| 4,969,574 | 11/1990 | Shastal | 215/253 X |

OTHER PUBLICATIONS

U.S. Ser. No. 07/345,998, Inventors: Richard A. Gross, Dieter F. Lay, Filed 5-May 2, 1989.

"Tamper Resistant Packaging from 3M", brochure (2 pages).

Affidavit of Bruce M. Mueller.

*Primary Examiner*—Stephen Marcus

*Assistant Examiner*—Paul A. Schwarz

[57] ABSTRACT

A container closure includes a body for mounting on the container. The body defines two spaced-apart surfaces and a dispensing orifice between the top surfaces. A flow control device, such as a lid or nozzle assembly, is disposed on the body between the two spaced-apart top surfaces for being moved between positions opening and closing the dispensing orifice. A tamper-indicating member is provided over the lid or nozzle assembly. The member has two spaced-apart outer sections which are each attached to one of the body top surfaces. The member also has a middle section extending across and over the lid or nozzle assembly. The middle section is joined on each side with a frangible web to an outer section to inhibit movement of the lid or nozzle assembly from the closed position. The tamper-indicating member also includes a graspable pull tab on the middle section. The tab can be pulled to tear the middle section away from the outer sections along the frangible webs for permitting the opening of the lid or nozzle assembly and for providing evidence of tampering with the closure.

33 Claims, 4 Drawing Sheets

CLOSURE WITH TAMPER-EVIDENT TEAR-OFF PANEL

TECHNICAL FIELD

This invention relates to closures for containers and, in particular to a closure which has a tamper-evident feature which blends in with, and/or enhances, the cosmetic appearance of the closure and yet can be readily manipulated by the user to permit opening of the closure while providing a clear indication of such manipulation.

BACKGROUND OF THE INVENTION AND TECHNICAL PROBLEMS POSED BY THE PRIOR ART

A variety of container closures have been developed or proposed wherein an initial opening of a lid or a dispensing spout structure provides visual evidence of such an occurrence.

See, for example, the U.S. Pat. No. 4,487,324 and the U.S. Pat. No. 4,941,592 which are assigned to Seaquist Closures, Crystal Lake, Ill., U.S.A. The closures disclosed in these patents incorporate a plurality of frangible webs molded from the same material as the closure lid and body so as to initially connect the closure lid to the body in the closed position. To initially open the closure, the user must break the frangible webs by pushing or pulling on a member that is connected to, and which is adjacent to, the frangible webs.

U.S. Pat. No. 4,467,931 discloses a closure in which a central lid is recessed flush with the peripheral top of the closure base and in which both the peripheral top of the closure base and the recessed lid are covered with an adhesively secured disk which must be torn off to permit opening of the lid.

While these closures can function generally satisfactorily for the purposes for which they have been designed, it would be desirable to provide an improved tamper-evident closure which could furnish a clear indication that the closure has been initially opened and which, prior to the initial opening, could blend in with, or enhance, the cosmetic appearance of the closure.

Further, it would be advantageous if such an improved closure could be initially opened relatively easily by the user.

It would also be beneficial if such an improved closure could be adapted for use on a variety of dispensing closure designs, such as the press-to-open pivoting nozzle type and such as the type having a base defining a dispensing orifice which is occluded by a hinged lid.

It would also be desirable to provide an improved tamper-evident closure design wherein a portion of the closure could be easily, and completely, removed for use as a "proof-of-purchase" panel or label.

Additionally, another salutary feature of such an improved closure would be the capability to accommodate the fabrication of the tamper-indicating panel from suitable materials that could be different from, or the same as, the material or materials employed in the rest of the closure. This would permit the panel to have a color different from the rest of the closure.

The present invention provides an improved closure which can accommodate designs having the above-discussed benefits and features.

SUMMARY OF THE INVENTION

The present invention provides a novel tamper-evident dispensing feature which blends well with, and/or enhances, the cosmetic appearance of the closure and yet can be easily manipulated by the user to permit the closure to be opened. It gives a clear indication of an initial opening of the closure. The feature can be adapted for use in a variety of dispensing closure designs.

The feature can be incorporated in a closure having a body suitable for mounting on a container. The body defines two spaced-apart top surfaces and a dispensing orifice between the top surfaces for communicating with the container interior from which the contents can be dispensed through the orifice.

A flow control means, such as a lid or nozzle assembly, is disposed on the body between the two spaced-apart top surfaces for being moved between positions opening and closing the dispensing orifice.

A tamper-indicating member is provided over the flow control means and body. The member has two spaced-apart outer sections which are each attached to a different one of the body top surfaces. The member also has a middle section extending across and over the flow control means. The middle section is joined on each side with a frangible web to an outer section to inhibit movement of the flow control means from the closed position.

The tamper-indicating member also includes a graspable pull tab means on the middle section for being pulled to tear the middle section away from the outer sections along the frangible webs. This permits the opening of the flow control means and provides evidence of tampering with the closure.

Numerous other advantages and features of the present invention will become readily apparent from the following detailed description of the invention, from the claims, and from the accompanying drawings.

BRIEF DESCRIPTION OF THE DRAWINGS

In the accompanying drawings that form part of the specification, and in which like numerals are employed to designate like parts throughout the same.

DESCRIPTION OF THE PREFERRED EMBODIMENTS

While this invention is susceptible of embodiment in many different forms, this specification and the accompanying drawings disclose only some specific forms as examples of the invention. The invention is not intended to be limited to the embodiments so described, however. The scope of the invention is pointed out in the appended claims.

For ease of description, the closure of this invention is described in the normal (upright) operating position, and terms such as upper, lower, horizontal, etc., are used with reference to this position. It will be understood, however, that the closure of this invention may be manufactured, stored, transported, used, and sold in an orientation other than the position described.

Some of the figures illustrating embodiments of the closure show structural details and mechanical elements that will be recognized by one skilled in the art. However, the detailed descriptions of such elements are not necessary to an understanding of the invention, and accordingly, are not herein presented.

Figures 1, 2, 3, 4, 5, 6, 7:
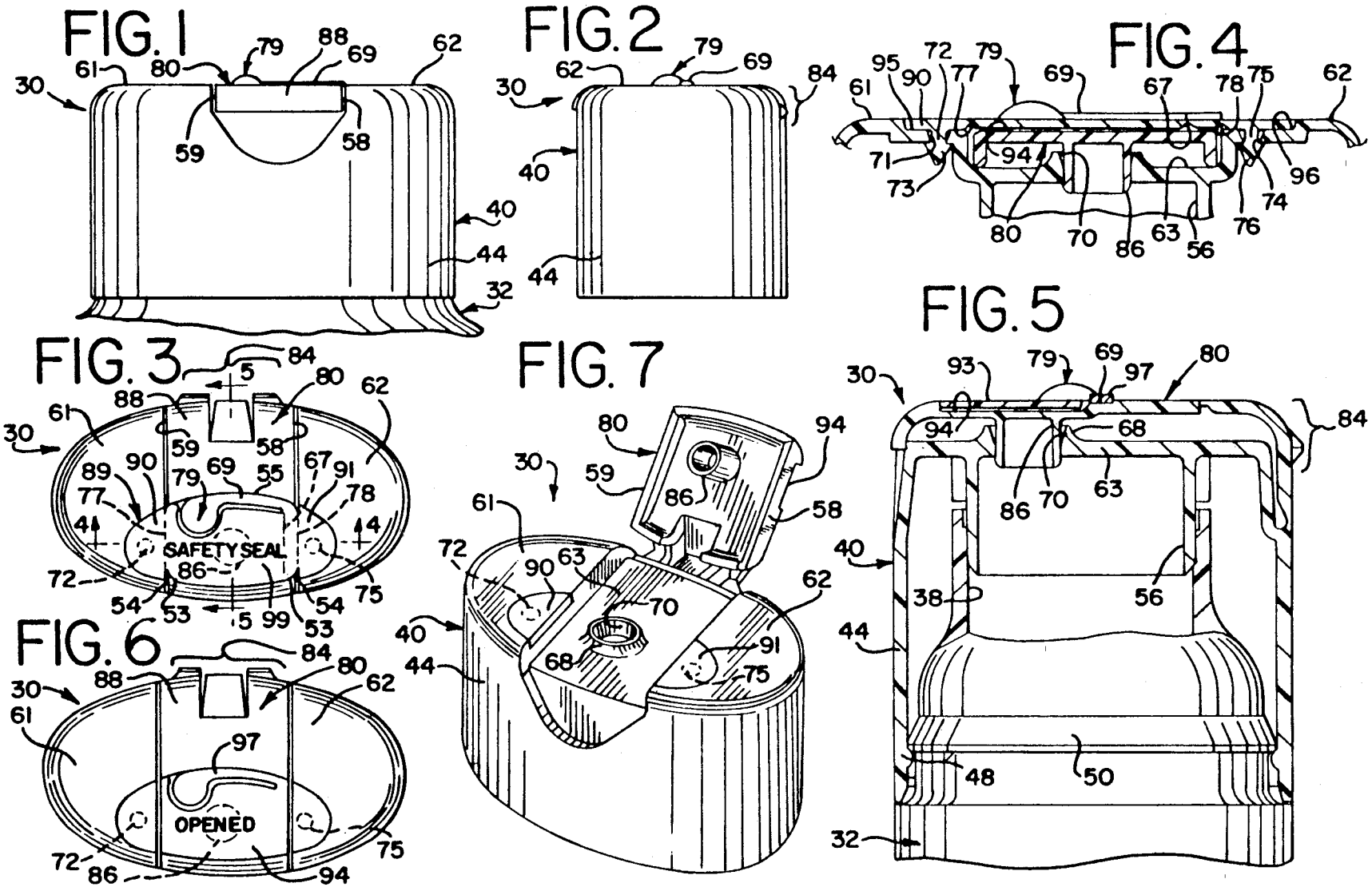
FIG. 1 is a fragmentary, front elevational view of a container together a first embodiment of the closure according to the present invention.
FIG. 2 is a side elevational view of the closure shown in FIG. 1.
FIG. 3 is a top, plan view of the closure shown in FIG. I.
FIG. 4 is a greatly enlarged, fragmentary, cross-sectional view taken generally along the plane 4—4 in FIG. 3.
FIG. 5 is a greatly enlarged, fragmentary, cross-sectional view taken generally along the plane 5—5 in FIG. 3.
FIG. 6 is a view similar to FIG. 3 but showing the closure after removal of the tamper-evident panel.
FIG. 7 is a perspective view of the closure shown in FIGS. 1–6 with the tamper-evident panel removed and the lid in an open position.
Figure 8:
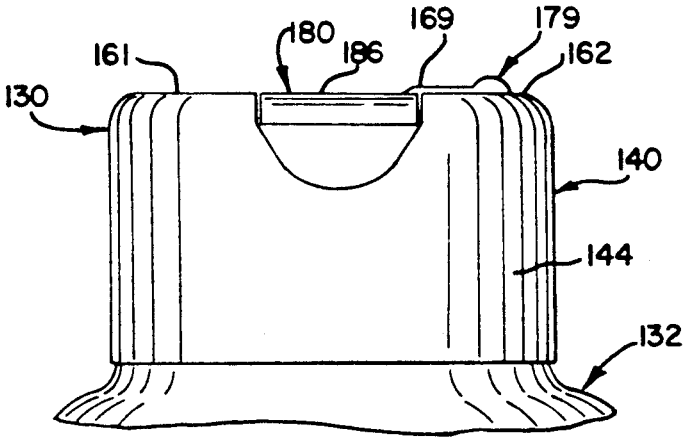
FIG. 8 is a fragmentary, front elevational view of a second embodiment of the closure.
Figure 9:
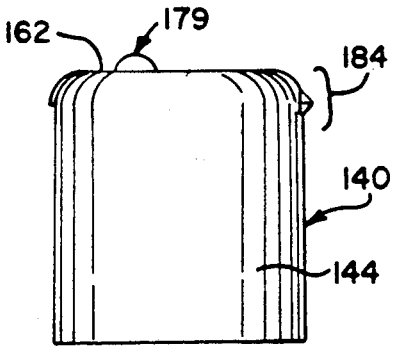
FIG. 9 is a side elevational view of the closure shown in FIG. 8.
Figure 10:
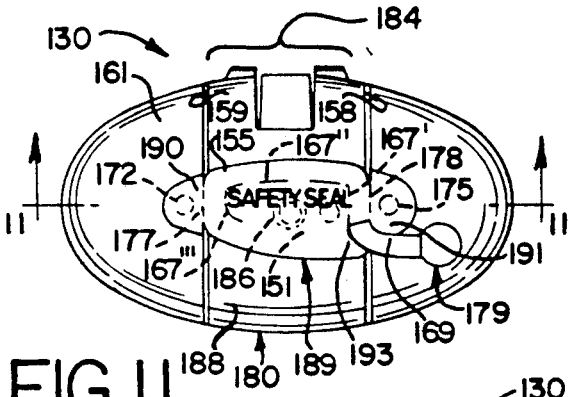
FIG. 10 is a top, plan view of the closure shown in FIG. 8.
Figure 12:
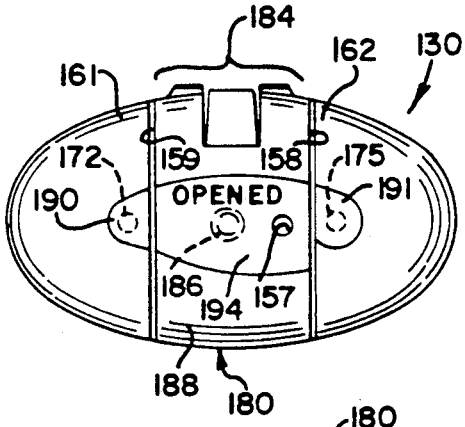
FIG. 12 is a view similar to FIG. 10 but showing the closure after removal of the tamper-evident panel.

A first form of a closure having a tamper-evident feature which blends in with, or enhances, the cosmetic appearance of the closure is illustrated in FIGS. 1-7 and is designated generally therein by the reference numeral 30. The closure 30 is shown mounted on a container 32. As illustrated in FIG. 5, the container 32 may be of any suitable special or conventional type and typically has a neck 36 which receives the closure 30 and which defines an opening 38 through which the container contents can be dispensed.

As best illustrated in FIG. 5, the closure 30 includes a housing, base, or body 40 for securement to the container 32. The embodiment illustrated in FIGS. 1-7, the closure body 40 includes a peripheral wall in the form of a cylindrical skirt 44. The skirt 44 includes, on its interior surface, a conventional snap-fit bead 48 or other suitable means (e.g., a thread (not illustrated)) for engaging a suitable cooperating means, such as a bead 50, on the container neck 36 to secure the closure body 40 to the container 32.

The closure body 40 also includes resilient, internal ring 56 which functions as a seal by protruding into and against the container neck 38

As best illustrated in FIGS. 4, 5, and 7, the closure body 40 includes a deck structure comprising two spaced-apart, horizontal, outer deck portions defining top surfaces 61 and 62 and a recessed central deck portion 63 between the outer deck portion surfaces 61 and 62.

The central deck portion 63 includes a collar 68 which projects upwardly around a cylindrical dispensing aperture or orifice 70 (FIGS. 5 and 7).

A flow control means in the form of a lid 80 is disposed on the body 40 between the two spaced-apart outer deck portion surfaces 61 and 62 and over the central deck portion 63. The lid 80 is adapted to be moved between an open position (FIG. 7) permitting the dispensing of the container contents and a closed position (FIGS. 1-6) in which the dispensing orifice 70 is occluded.

The lid 80 may be completely removable from the closure body 40 or may be attached to it. In the embodiment illustrated in FIGS. 1-7, the lid 80 is connected to the closure body 40 by a suitable means, such as a snap-action hinge 84. Such a snap-action hinge 84 is formed integrally with the closure body 40 and lid 80. Preferably the closure body, lid, and hinge are molded from suitable thermoplastic materials compatible with the container and its contents. The illustrated snap-action hinge 84 is a conventional type described in the Seaquist Closures U.S. Pat. No. 4,964,539 with reference therein to FIGS. 1-6. The particular hinge structure forms no part of the present invention.

The lid 80 also includes a downwardly projecting plug 86 (FIGS. 5 and 7) for entering into the dispensing orifice 70 when the lid is closed (FIG. 5) to occlude the opening.

As best illustrated in FIGS. 1-5, the lid 80 has a generally flat upper surface 88, and in the preferred embodiment the surface 88 has a generally planar configuration. Further, in the preferred embodiment, the spaced-apart top surfaces 61 and 62 of the closure body are also generally planar, and the lid upper surface 88 is general co-planar with the top surfaces 61 and 62.

A novel tamper-indicating member 89 is mounted over the lid 80 and over the body top surfaces 61 and 62 as illustrated in FIGS. 3-5. The tamper-indicating member 89 has two spaced-apart, outer sections 90 and 91 and a middle section 93 extending across and over the lid 80.

The tamper-evident member 89 is received on the closure 30 in a manner that blends in with, or enhances the cosmetic appearance of, the closure. To this end, the closure lid 80 has a recessed surface 94 (FIGS. 4-6) for receiving the tamper-indicating member middle section 93. Similarly, the body top surface 61 defines a recess 95 for receiving the tamper-indicating member outer section 90, and the body top surface 62 defines a recess 96 for receiving the tamper-indicating member outer section 91.

The outer sections 90 and 91 of the tamper-indicating member 89 are attached to the body in a novel manner. Specifically, as illustrated in FIG. 4, in the floor of the recess 95 there is a retention aperture, such as a bore 71, and the tamper-indicating member outer section 90 includes a downwardly depending pin 72 which is disposed within the retention bore 71. The pin 72 has an enlarged, conical distal end 73 with a transverse dimension greater than the transverse dimension or diameter of the bore 71. The enlarged end 73 of the pin 72 retains the pin within the closure body.

Similarly, there is a retention aperture, such as a bore 74 defined in the floor of the recess 96 under the other outer section 91 of the tamper-indicating member 89. The outer section 91 includes a downwardly projecting pin 75 extending through the bore 74. The pin 75 has an enlarged distal end 76 which, in the preferred form illustrated, has a conical configuration for retaining the outer section 91 within the recess 96.

The tamper-indicating member 89 may be fabricated from various suitable materials. In a preferred form, the tamper-indicating member 89 is molded from polyethylene and has sufficient resiliency to accommodate insertion of the attaching pin conical ends 73 and 76 through the closure body recess bores 71 and 74, respectively, so as to mount the tamper-indicating member 89 across the closed lid as illustrated in FIGS. 1-5.

The tamper-indicating member 89 further includes an outer frangible web 77 connecting the middle section 93 to the outer section 90 and includes an outer frangible web 78 connecting the middle section 93 to the other outer section 91. Each frangible web 77 and 78 is defined by a reduced thickness portion of the tamper-indicating member 89 which is present at the apex of an inverted V-shaped notch as visible in FIG. 4. In FIG. 3, the webs 77 and 78 are represented by dashed lines for purposes of illustration only. The webs per se would present a surface appearance no different from the adjacent top surface of the member 89. Other forms of a frangible web could be employed, such as perforations, score lines, or the like. Such forms could be visible from the top to the extent that the top surface of the member 89 would be affected.

When the tamper-indicating member 89 is attached to the closure as illustrated in FIGS. 1-5, the movement of the lid 80 upwardly from the closed position (FIGS. 1-5) to an open position (FIG. 7) is prevented, or at least inhibited. An attempt to push or lift the lid 80 upwardly is resisted by the tamper-indicating member 89 which is attached on either side of the lid 80 to the closure body deck by means of the retention pins 72 and 75.

In a preferred form of the invention, the frangible webs 77 and 78 have a thickness sufficient to prevent the lid 80 from being lifted upwardly when subjected to the forces typically applied by the average person's fingers (and without a tool). However, even if the frangible webs 77 and 78 were ruptured or broken by excessive forces, or by severing with a tool, then the broken tamper-indicating member 89 would thereafter provide evidence that either the closure had been opened or at least there had been an attempt to tamper with the closure.

The lid 80 can be characterized as having a side edge 59 and a side edge 58 (FIGS. 1, 3, 6, and 7). The tamper-indicating member 89 can be further characterized as having a peripheral margin which crosses over each lid side edge portion 59 and 58 at two spaced-apart locations along each lid side edge. Further, the tamper indicating member middle section 93 can be characterized as having an exterior rear edge 55 extending between the outer frangible webs 77 and 78 on the periphery of the section 93 which faces the hinge 84.

The tamper-indicating member 89 defines an notch configuration in the peripheral margin at each of the spaced-apart locations where the peripheral margin of the member 89 crosses over one of the lid side edges 58 or 59. As can be seen in FIG. 3, each notched configuration includes a straight edge 54 and a curved edge 53 merging with the straight edge. The curved edge 53 merges with the straight edge 54 at a point that is substantially in registry with one of the lid side edges 58 or 59.

It will be appreciated that the curved edge 53 of each notch is defined by part of the boundary of the tamper-indicating member middle section 93 and that the straight edge 54 of each notch is defined by a part of the boundary of one of the tamper-indicating member outer sections (90 or 91). Each curved edge 53 is outwardly convex relative to the tamper-indicating member middle section 93 which defines it. This novel structure aids in the severing of the frangible webs 77 and 78 when the tamper-indicating member 89 is manipulated as explained in detail hereinafter.

In the preferred embodiment illustrated in FIGS. 1-7, a novel means is provided for permitting the tamper-indicating member 89 to be easily manipulated for permitting the lid 80 to be opened. Specifically, the tamper-indicating member 89 includes a pull tab 79 which has a peripheral connecting portion 69 that is unattached to the tamper-indicating member middle section 93 except at one end where it merges with, or is attached to, the middle section 93. The middle section 93 further defines an inner frangible web 67 (FIGS. 3 and 4) which extends from the end of the tab connecting portion 69 along, but spaced inwardly of, the outer frangible web 78. The inner frangible web 67 does not extend completely across the middle section 93 and terminates short of the front edge of the middle section 93.

The tab 79, in the embodiment illustrated in FIGS. 1-5, is supported by the lid 80 in a recess 97 (FIGS. 5 and 6) which is shallower than the main middle section recess 94. The recess 97 provides a shoulder, relative to the main recess 94, for receiving the tab 79. This causes the tab 79 to have a slightly raised profile as can be seen in FIG. 4. This facilitates the gripping of the tab 79.

When it is desired to open the closure, the tab 79 is grasped and lifted upwardly away from the lid 80. The tab 79 is then pulled, and this ruptures the outer frangible web 78 and the inner frangible web 67 along the lid edge 58 between the tamper-indicating member outer section 91 and middle section 93.

Continued pulling of the tab 79 lifts the now unconnected portion of the middle section 93 upwardly and off of the lid 80. Further pulling of the tab 79 causes the frangible web 77 adjacent the other outer section 90 to be ruptured. This completely separates the middle section 93 from each outer section 90 and 91. The lid 80 can then be easily lifted to the open position (FIG. 7).

If desired, the closure illustrated in FIGS. 1-7 could be modified by including a light adhesive 30 under the tamper-indicating member middle section 93. This is not necessary, but may serve to inhibit the intentional or accidental insertion of a thin member between the top of the lid 80 and the bottom of the tamper-indicating member middle section 93. This would inhibit snagging and possible partial rupture of the frangible webs in a manner other than by the desired pulling on the tab 79.

It will also be appreciated that the tamper-indicating member outer sections 90 and 91 may be attached to the closure body without using the pins 72 and 75. For example, the outer sections 90 and 91 may be secured with sonic welding, adhesive, tabs, etc.

Also, the frangible webs 67, 77, and 78 may be formed with notches, score lines, etc., in the top surface of the tamper-indicating member 89 rather than in the bottom surface as illustrated. Further, instead of providing only one tab 79, two separate pull tabs could be provided—one along the web 78 and one along the web 77. Each such separate tab, which could be joined at their grippable ends, would extend completely across the middle section 93 rather than terminate short of the full width as does tab 79 along the inner frangible web 67. Each such separate tab would have a portion defined on one side by one of the outer frangible webs 77 or 78 and defined on the other side by an inner frangible web similar to web 67 but extending completely across the middle section 93.

In addition, the top surface of the tamper-indicating member 89 could be marked with distinctively colored lines in registry with the frangible webs 67, 77, and 78 (or additional frangible webs as may be provided in accordance with alternate embodiments discussed hereinafter). This would provide the user with guidance when tearing off the tab or tabs.

The middle section 93 of the tamper-indicating member 90 is adapted to carry indicia, such as the words "SAFETY SEAL" as shown in FIG. 3. Upon removal, the lid recess 94 is exposed. That recess is also adapted to carry indicia, such as the word "OPENED" as shown in FIG. 6. The indicia may be molded directly into the tamper-indicating member 89 and into the closure lid 80 or may be printed on suitable labels that are adhesively applied.

In addition, the tamper-indicating member middle section 93 may function as a proof-of-purchase feature. For example, a label bearing the desired instructions, codes, advertising, etc., may be applied to the upper or lower surface of the middle section 93. After the middle section 93 has been torn away from the closure, it can be used as a proof-of-purchase in the same manner as parts of conventional packages are typically used.

It will be appreciated that the tamper-indicating member 89 may be separately fabricated from suitable materials and in any desired color. A variety of shapes may be employed to conform to, or contrast with, the shape of the closure.

The tamper-indicating member 89 can also be applied to a variety of closures and can accommodate novel modifications as will next be explained with reference to further embodiments illustrated in FIGS. 8-24.

In the following description, three digit numerals in the 100 series are used to refer to the embodiment illustrated in FIGS. 8-13, three digit numerals in the 200 series are used to refer to the embodiment illustrated in FIGS. 14-20, and three digit numerals in the 300 series are used to refer to the embodiment illustrated in FIGS. 21-24. The same last two digits in each numeral designate elements which are similar or functionally analogous to the elements identified with the same two digits in the first embodiment described above with reference to FIGS. 1-7.

The alternate form of the closure illustrated in FIGS. 8-13 is designated generally by the reference numeral 130. The closure 130 includes a housing, base, or body 140 for securement to a container 132. As in the first embodiment illustrated in FIGS. 1-7, the base 140 includes a skirt 144 having a seal 156 for engaging the container 132.

Figure 11:
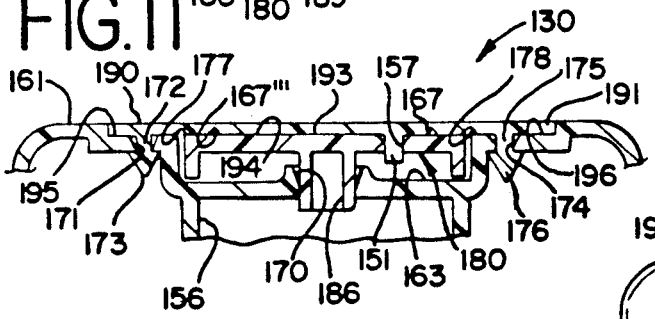
FIG. 11 is a greatly enlarged, fragmentary, cross-sectional view taken generally along the plane 11—11 in FIG. 10.
Figure 13:
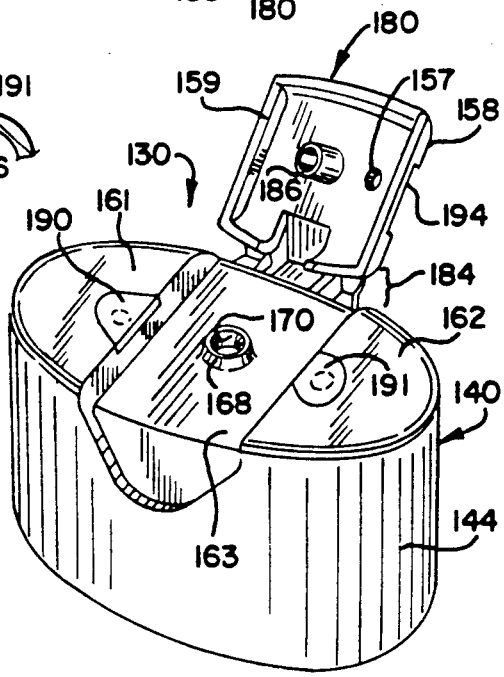
FIG. 13 is a perspective view of the closure shown in FIGS. 8-12 with the tamper-evident panel removed and the lid in an open position.

As best illustrated in FIGS. 11 and 13, the closure body 140 includes a deck structure comprising two spaced-apart, horizontal, outer deck portions defining top surfaces 161 and 162. The closure body 140 has a recessed central deck portion 163 between the outer deck portion top surfaces 161 and 162.

The central deck portion 163 includes a collar 168 which projects upwardly around a cylindrical dispensing aperture or orifice 170 (FIG. 13).

A flow control means, such as a lid 180, is disposed on the body 140 between the two spaced-apart outer deck portion top surfaces 161 and 162 and over the central deck portion 163. The lid 180 is adapted to be moved between an open position (FIG. 13) for permitting the dispensing of the container contents and a closed position (FIGS. 8-12) in which the dispensing orifice 170 is occluded.

The lid 180 has a top surface 188 and also includes a downwardly projecting plug 186 (FIGS. 11 and 13) for entering into the dispensing orifice 170 when the lid is closed to occlude the opening.

In the embodiment illustrated in FIGS. 8-13, the lid 180 is connected on one end to the closure body 140 by a suitable means, such as a snap-action hinge 184. The lid 180 is defined on each side by edges 158 and 159.

A novel tamper-indicating member 189 is mounted over the lid 180 and body top surfaces 161 and 62 as illustrated in FIGS. 8-11. The tamper-indicating member 189 has two spaced-apart outer sections 190 and 191 and a middle section 193 extending across and over the lid.

The tamper-indicating member 189 is received on the closure 130 in a manner that blends in with, or enhances the cosmetic appearance of, the closure 130. To this end, the closure lid 180 defines a recess 194 (FIGS. 11-13) for receiving the tamper-indicating member middle section 193. Similarly, the body top surface 161 defines a recess 195 for receiving the tamper-indicating member outer section 190, and the body top surface 162 defines a recess 196 for receiving the tamper-indicating member outer section 191.

The outer sections 190 and 191 of the tamper-indicating member 189 are attached to the closure body 140 with pins 172 and 175 in the same manner as in the first embodiment described above with reference to FIGS. 1-7. The pins 172 and 175 are received in bores 171 and 174, respectively, and are retained therein by enlarged ends 173 and 176, respectively.

However, unlike the preferred form of the first embodiment described above with reference to FIGS. 1-7, the second embodiment of the closure has a tamper-indicating middle section 193 which is attached in a novel way directly to the closure lid 180. Specifically, the middle section 193 includes a downwardly projecting pin or post 151, and the floor of the recess 194 of the lid 180 defines a retention cavity or bore 157 for receiving the post 151 in an interference fit. This increases the resistance of the middle section 193 to removal from the lid 180. If desired, the engagement structure provided by the post 151 and bore 157 could be replaced by a region of adhesive.

The tamper-indicating member 189 further includes an outer frangible web 177 connecting the middle section 193 to the outer section 190 and includes an outer frangible web 178 connecting the middle section 193 to the other outer section 191.

The tamper-indicating member middle section 193 defines an exterior rear edge 155 extending between the two outer frangible webs 177 and 178. A pull tab 179 is provided on the tamper-indicating member 189. The tab 179 has a peripheral portion 169 which is unattached to the middle section 193 except at one end where it merges in a unitary manner with the middle section 193.

The tamper-indicating member middle section 193 further defines an inner frangible web having three segments adjacent three different peripheral regions of the middle section 193. Specifically, there is a first segment 167' extending from the portion 169 generally along, but spaced inwardly of, the adjacent outer frangible web 178. The web segment 167' does not extend completely across the middle section 193. Rather, it terminates short of the rear edge 155. A second segment 167'' extends from the first web segment 167' generally along, but spaced inwardly of, the exterior rear edge 155. A third segment 167''' extends from the second web segment 167'' generally along, but spaced inwardly of, the other outer frangible web 177.

When it is desired to open the closure 130, the tab 179 is grasped and lifted upwardly away from the lid 180. The tamper-indicating member middle section 193 is initially retained against the top of the lid 180 by the engagement of the post 151 in the lid 180. As the tab 179 is pulled, the outer frangible web 178 and the first segment 167' of the inner frangible web 167 are severed. Continued pulling of the tab severs the second segment 167'' of the inner frangible web. Further pulling of the tab 179 ruptures the outer frangible web 177 and the adjacent inner frangible web third segment 167'''. A final tug on the tab 179 is then sufficient to overcome the engaging force between the post 151 and lid 180 so that the entire middle section 193 of the tamper-indicating member 189 is pulled off of the lid 180.

The third embodiment of the closure illustrated in FIGS. 14-20 is designated generally by the reference numeral 230. The closure 230 includes a housing, base, or body 240 for securement to a container 232. As in the first embodiment illustrated in FIGS. 1-7, the base 240 includes a skirt 244 having a seal 256 for engaging the container 232.

Figures 14, 15, 16, 17, 18, 19, 20:
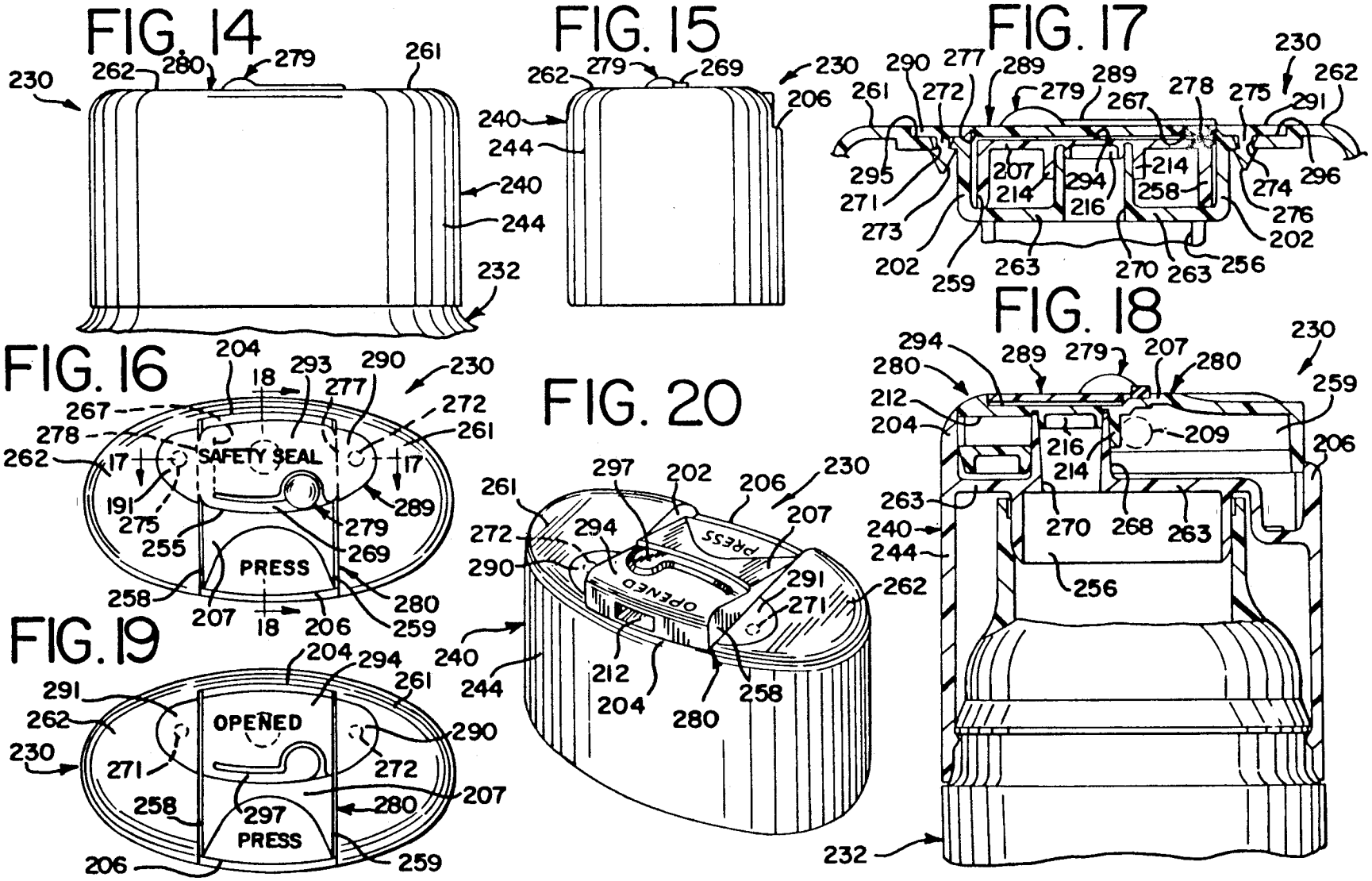
FIG. 14 is a fragmentary, front elevational view of a third embodiment of the closure.
FIG. 15 is a side elevational view of the closure shown in FIG. 14.
FIG. 16 is a top, plan view of the closure shown in FIG. 14.
FIG. 17 is a greatly enlarged, fragmentary, cross-sectional view taken generally along the plane 17—17 in FIG. 16.
FIG. 18 is an enlarged, fragmentary, cross-sectional view taken generally along the plane 18—18 in FIG. 16.
FIG. 19 is a top, plan view of the closure shown in FIG. 16 with the tamper-evident panel removed.
FIG. 20 is a perspective view of the closure shown in FIGS. 14-19 with the tamper-evident panel removed and the dispensing nozzle pivoted to an open, dispensing position.

As best illustrated in FIGS. 17 and 20, the closure body 240 includes a deck structure comprising two, horizontal, outer deck portions having top surfaces 261 and 262 and a recessed central deck portion 263 between the outer deck portion top surfaces 261 and 262.

The central deck portion 263 includes a dispensing tube or collar 268 which projects upwardly around a cylindrical dispensing aperture or orifice 270 (FIGS. 17 and 18).

A flow control means in the form of a nozzle assembly 280 is disposed on the body 240 between the two spaced-apart outer top surfaces 261 and 262 over the central deck portion 263. The nozzle assembly 280 is adapted to be pivoted between an open position (FIG. 20) permitting the dispensing of the container contents and a closed position (FIGS. 14–19) in which the dispensing orifice 270 is occluded.

As best illustrated in FIG. 17, the closure body 140 includes a pair of spaced-apart sidewalls 202 which extend upwardly from the central deck portion 263 to one or the other of the outer deck top surfaces 261 and 262. The closure body 240 also includes a upwardly projecting front wall 204 (FIGS. 2–4) and a notched rear wall 206.

The nozzle assembly 280 includes a top wall 207 and a pair of spaced-apart side edges or flanges 258 and 259 (FIGS. 16 and 17). Each flange 258 and 259 includes a projecting hemispherical perturberance or pivot member 209 (FIG. 18), and these pivot members cooperate with the closure body walls 202 for mounting the nozzle assembly 280 in the closure body 240. In particular, each vertical wall 202 in the closure body 240 defines a mating hemisperical recess (not visible in the figures) for a snap-fit receipt of one of the pivot members 209 to accommodate pivoting movement of the nozzle assembly 280 about a pivot axis defined by the pivot members 209 in the receiving recesses.

When the nozzle assembly 280 is properly mounted to the closure body 240, the nozzle assembly 280 can be pivoted by pushing downwardly on the rear portion of the nozzle assembly 280. The forward end of the nozzle assembly 280 is then exposed above the top edge of the closure body front wall 204 as shown in FIG. 20. . In order to accommodate the downward pressing of the rear portion of the nozzle assembly 280, the body rear wall 206 is cut away or notched as can be seen in FIG. 20.

The nozzle assembly 280 includes a top wall 207 and a valve structure on the lower surface of the nozzle top wall 207 for either conducting the flowable material from the container dispensing tube 268 or for occluding flow out of the tube 268—depending upon the orientation of the nozzle assembly 280. In particular, the nozzle assembly 280 includes a nozzle or channel 212 (FIGS. 18 and 20) which terminates at a generally semi-cylindrical sealing wall 214 (FIGS. 17 and 18). A sealing plug 216 projects downwardly in the nozzle 212 from the nozzle assembly top wall 207. The sealing plug 216 has a generally cylindrical or annular configuration and is adapted to enter into the opening at the top of the dispensing tube 268 to sealingly occlude the tube 268 when the nozzle assembly 280 is in the closed position as illustrated in FIGS. 14–19.

On the other hand, when the nozzle assembly 280 is tilted to the dispensing position as illustrated in FIG. 20, the sealing wall 214 seals off the region above the tube 268 around the rear of the tube 268 while the sealing plug 216 is tilted away from the top front portion of the tube 268 to permit flow of the material out of the opening of the tube 268 and through the dispensing nozzle 212.

Insofar as the nozzle assembly interior structure and cooperating closure body mounting structure have been described, these structures are substantially conventional, and additional features typically employed with such a dispensing nozzle assembly may be incorporated if desired. See, for example, Seaquist Closures U.S. Pat. Nos. 4,962,869 and 4,776,501. The detailed internal nozzle structure and body mounting structure form no part of the present invention.

In accordance with the present invention, a novel tamper-indicating member 289 is mounted over the nozzle assembly 280 and over the body top surfaces 261 and 262 as illustrated in FIGS. 14–18. The tamper-indicating member 289 has two spaced-apart outer sections 290 and 291 and a middle section 293 extending across and over the nozzle assembly.

The tamper-evident member 289 is received on the closure 230 in a manner that blends in with, and/or enhances the cosmetic appearance of, the closure 230. To this end, the closure nozzle assembly 280 defines a recess 294 (FIGS. 17-19) for receiving the tamper-indicating member middle section 293. Similarly, the body top surface 261 defines a recess 295 for receiving the tamper-indicating member outer section 290, and the body top surface 262 defines a recess 296 for receiving the tamper-indicating member outer section 291.

The outer sections 290 and 291 of the tamper-indicating member 289 are attached to the closure body 240 with pins 271 and 275 (FIG. 17) in the same manner as in the first embodiment described above with reference to FIGS. 1-7. The pins 272 and 275 are received in bores 271 and 274, respectively, and are retained therein by enlarged ends 273 and 276, respectively.

The middle section 293 is not secured directly to the nozzle assembly 280. However, in an alternate design a direct attachment could be provided (e.g., a light adhesive or other suitable means).

As illustrated in FIGS. 17 and 16, the tamper-indicating member 289 further includes an outer frangible web 277 connecting the middle section 293 to the outer section 290 and includes an outer frangible web 278 connecting the middle section 293 to the other outer section 291. The tamper-indicating member middle section 293 further defines an inner frangible web 267 extending generally along, but spaced inwardly of, the adjacent outer frangible web 278.

The tamper-indicating member middle section 293 defines a rear exterior edge 255 (FIG. 16) extending between the two outer frangible webs 277 and 278. The tamper-indicating member 289 is provided with a pull tab 279 along the edge 255. The tab 279 has a peripheral portion 269 which is unattached to the middle section 293 except at one end where it merges in a unitary manner with the middle section 293.

When it is desired to open the closure 230, the tab 279 is grasped and lifted upwardly away from the nozzle assembly 280. As &:he tab 279 is pulled, the frangible webs 267, 277, and 278 are severed so that the entire middle section 293 of the tamper-indicating member 289 is pulled off of the lid 280.

The fourth embodiment of the closure illustrated in FIGS. 21-24 is designated generally by the reference numeral 330. The closure 330 includes a housing, base, or body 340 with a skirt 344 for securement to a container 332.

A pivotable nozzle assembly 380 is mounted in the closure base 340. The structure of the closure base and nozzle assembly is substantially similar to that employed in the closure 230 described above with reference to FIGS. 14-20. However, the exterior shape of the closure base 340 has been altered to provide a different, but aesthetically interesting, configuration, and the nozzle assembly 380 is somewhat shorter—terminating further inwardly from the front of the closure base skirt 344.

A main difference between the closure 330 and the closure 230 is that the closure 330 employs a different form of the tamper-indicating member. Rather than using the tamper-indicating member 289 of the closure 230, the closure 330 incorporates a tamper-indicating member 389 which is functionally similar to the tamper-indicating member 189 of the closure 130 described above with reference to FIGS. 8-13.

Figure 24:
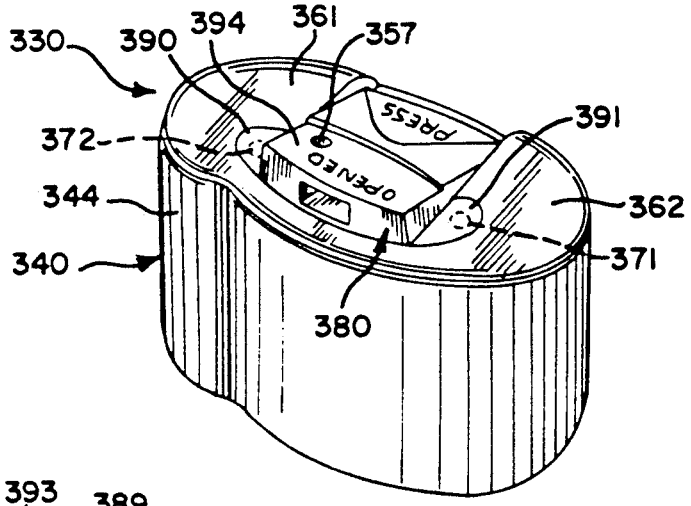
FIG. 24 is a perspective view of the closure shown in FIGS. 20-23 with the tamper-evident panel removed and the dispensing nozzle pivoted to an open, dispensing position.
Figure 21:
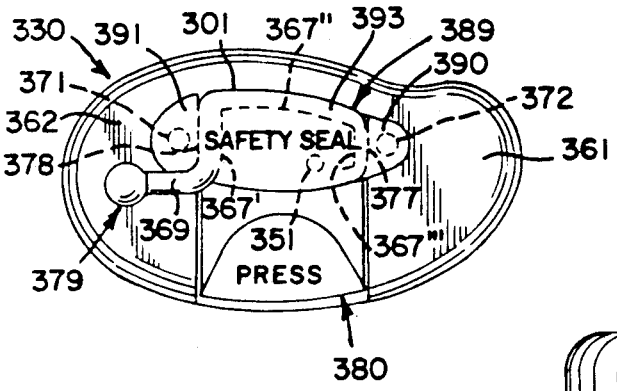
FIG. 21 is a top, plan view of the fourth form of the closure of the present invention.
Figure 22:
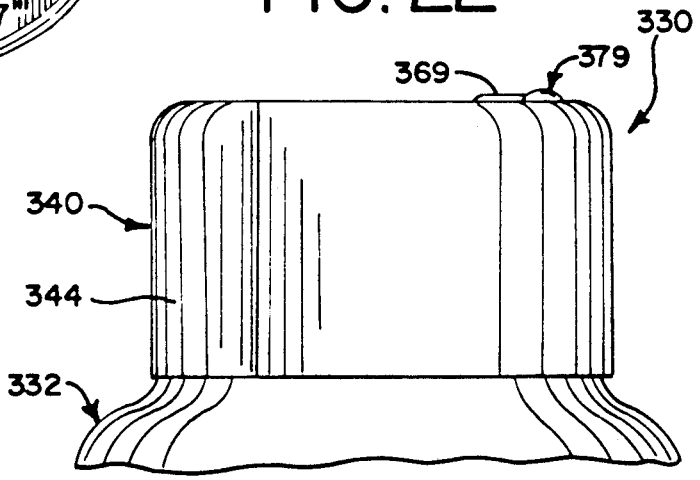
FIG. 22 is a fragmentary, front, elevational view of the closure shown in FIG. 21.
Figure 23:
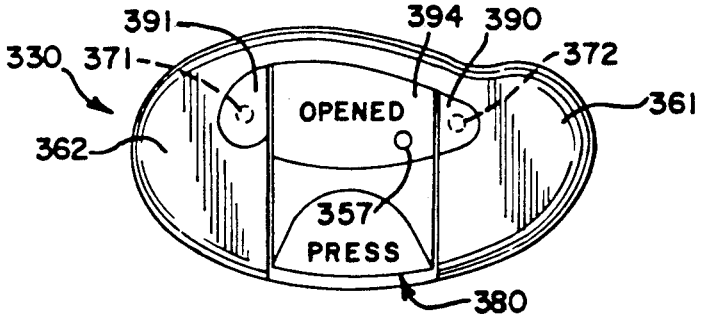
FIG. 23 is a top, plan view of the closure shown in FIG. 21 with the tamper-evident panel removed.

As best illustrated in FIGS. 21, 23, and 24, the closure body 340 includes a deck structure comprising two, horizontal, outer deck portions having top surfaces 361 and 362 between which the nozzle assembly 380 is disposed. The tamper-indicating member 389 is mounted over the nozzle assembly 380 and over the body top surfaces 361 and 362 as illustrated in FIGS. 21-23. The tamper-indicating member 389 has two spaced-apart outer sections 390 and 391 and a middle section 393 extending across and over the nozzle assembly 380.

The tamper-indicating member 389 is received on the closure 330 in a manner that blends in with, and/or enhances, the cosmetic appearance of the closure 330. To this end, the closure nozzle assembly 380 defines a recess 394 (FIGS. 23 and 24) for receiving the tamper-indicating member middle section 393. Similarly, the body top surfaces 361 and 362 define recesses (not visible) for receiving the tamper-indicating member outer sections 390 and 391, respectively. The middle section 393 is located with its leading edge 301 (FIG. 21) in registration with the front edge of the nozzle assembly 380.

The outer sections 390 and 391 of the tamper-indicating member 389 are attached to the closure body 340 with pins 371 and 375 in the same manner as in the closure embodiments described above with reference to FIGS. 1-23.

The middle section 393 is attached directly to the nozzle assembly 380. Specifically, the middle section 393 includes a downwardly projecting pin or post 351, and the top wall of the nozzle assembly 380 defines a retention cavity or bore 357 for receiving the post 351 in an interference fit. This increases the resistance of the middle section 393 to removal from the nozzle assembly 380. This arrangement is identical to the attachment configuration for the closure 130 described above with reference to FIGS. 8-13.

The tamper-indicating member 389 further includes an outer frangible web 377 connecting the middle section 393 to the outer section 390 and includes an outer frangible web 378 connecting the middle section 393 to the other outer section 391.

A pull tab 379 is provided on the tamper-indicating member 389. The tab 379 has a peripheral portion 369 which is unattached to the middle section 393 except at one end where it merges in a unitary manner with the middle section 393.

The tamper-indicating member middle sections 393 further defines an inner frangible web having-three segments adjacent three different peripheral regions of the middle section 393. Specifically, there is a first segment 367' extending from the portion 369 and generally along, but spaced inwardly of, the adjacent outer frangible web 378. The web segment 367' does not extend completely across the middle section 393. Rather, it terminates short of the front edge 301. A second segment 367'' extends from the first web segment 367' generally along, but spaced inwardly of, the exterior front edge 301. A third segment 367''' extends from the second web segment 367'' generally along, but spaced inwardly of, the other outer frangible web 377.

When it is desired to open the closure 330, the tab 379 is grasped and lifted upwardly away from the nozzle assembly 380. The tamper-indicating member middle section 393 is initially retained against the top of the lid 380 by the engagement of the post 351 in the nozzle assembly 380. As the tab 379 is pulled, the outer frangible web 378 and the first segment 367' of the inner frangible web are severed. Continued pulling of the tab severs the second segment 367'' of the inner frangible web. Further pulling of the tab 379 ruptures the outer frangible web 377 and the adjacent inner frangible web third segment 367'''. A final tug on the tab 379 is then sufficient to overcome the engaging force between the post 351 and nozzle assembly 380 so that the entire middle section 393 of the tamper-indicating member 389 is pulled off of the nozzle assembly 380 as shown in FIG. 23. The nozzle assembly 380 can then be pivoted to the open position (FIG. 24).

It will be apparent from the foregoing detailed description of various embodiments of the present invention that the present invention provides a novel tamper-indicating feature which can be furnished in a variety of closure designs. The novel tamper-evident feature blends with, and/or enhances, the cosmetic appearance of the closure. However, the tamper-evident feature can be easily manipulated by the user to permit the closure to be opened while at the same time giving a clear indication of such manipulation.

It will be readily apparent from the foregoing detailed description of the invention an from the illustrations thereof that numerous variations and modifications may be effected without departing from the true spirit and scope of the novel concepts or principles of this invention.

What is claimed is:

1. A tamper-evident dispensing closure comprising:

a body suitable for mounting on a container and defining two spaced-apart top surfaces and a dispensing orifice between said top surfaces for communicating with said container for dispensing the contents thereof;

a flow control means disposed on said body between said two spaced-apart top surfaces for being moved between positions opening and closing said dispensing orifice, said flow control means defining an indicium facing outwardly when said flow control means is in the closed position; and a tamper-indicating member over said flow control means and body, said member having two spaced-apart outer sections which are each separate from, but extend over and are attached to a different one of said body top surfaces, and tamper-indicating member having a middle section extending across and over said flow control means to cover said indicium, said member including a frangible web on each side of said middle section for joining said middle section on each side to one of said two outer sections to inhibit movement of said flow control means from said closed position, said member further including graspable pull tab means on said middle section for being pulled to tear said middle section away from said outer sections along said frangible webs to expose said indicium while said outer sections remain attached to said body for extending over said body top surfaces and to thereby permit the opening of said flow control means and provide evidence of tampering with said closure.

2. The closure in according with claim 1 in which said body is a separate from, but attachable to, an open end of said container.

3. The closure in accordance with claim 1 which said middle section of said tamper-indicating member is attached to said flow control means.

4. The closure in accordance with claim 1 in which said body top surfaces are generally flat and coplanar.

5. The closure in accordance with claim 1 in which said flow control means has at least one side edge and each said frangible web is substantially parallel to, and adjacent, one of said side edges.

6. The closure in accordance with claim 1 in which said flow control means has an upper surface with portions that substantially conform to said body top surfaces when said flow control means is in said closed position;

said flow control means upper surface also has a portion defining a recess for receiving said middle section of said tamper-indicating member; and said body top surfaces define recesses for receiving said outer sections of said tamper-indicating member.

7. The closure in accordance with claim 1 in which said body has two spaced-apart outer deck portions each defining one of said top surfaces, each said outer deck portion defining a retention aperture, each said outer section of said tamper-indicating member including a downwardly depending pin having an enlarged distal end with a transverse dimension greater than a transverse dimension of one of said apertures, and each said pin being disposed within one of said apertures with said enlarged distal end projecting from said one aperture below one of said outer deck portions to retain said pin within said one outer deck portion whereby each said outer section of said tamper-indicating member is attached to one of said outer deck portions of said body.

8. The closure in accordance with claim 7 in which at least one of said pin and engaged outer deck portion is resilient to accommodate insertion of said one pin into said retention aperture.

9. The closure in accordance with claim 1 in which said flow control means is a lid hinged to said body;

said body includes a recessed central deck portion below said lid, and said central deck portion defines said dispensing orifice;

said lid defines a recessed surface for receiving said middle section of said tamper-indicating member and further defines an upwardly open retention cavity spaced from said dispensing orifice; and said middle section of said tamper-indicating member includes a downwardly projecting post received in said retention cavity in an interference fit so as to increase the resistance of said middle section to removal from said lid.

10. The closure in accordance with claim 9 in which said retention cavity is a bore through said lid; and said post is a cylindrical member.

11. The closure in accordance with claim 10 in which at least one of said post and lid is resilient to accommodate insertion of said post into said retention cavity.

12. The closure in accordance with claim 1 in which each said frangible web is defined by a reduced thickness of said tamper-indicating member.

13. The closure in accordance with claim 1 in which said flow control means defines a generally flat upper surface;

said spaced-apart top surfaces of said body are generally flat and co-planar; and said flow control means upper surface is generally co-planar with said top surfaces of said body.

14. The closure in accordance with claim 1 in which said flow control means is a pivotable nozzle assembly.

15. A tamper-evident dispensing closure comprising:

a body suitable for mounting on a container and defining two spaced-apart top surfaces and a dispensing orifice between said top surfaces for communicating with said container for dispensing the contents thereof;

a flow control means disposed on said body between said two spaced-apart top surfaces for being moved between positions opening and closing said dispensing orifice, said flow control means defining an indicium facing outwardly when said flow control means is in the closed position, said flow control means having two-spaced apart side edge portions; and a tamper-indicating member over said flow control means and body, said member having two spaced-apart outer sections which are each separate from, but extend over and are attached to, a different one of said body top surfaces, and tamper-indicating member having a middle section extending across and over said flow control means to cover said indicium, said member including a frangible web on each side of said middle section for joining said middle section on each side to one of said two outer sections to inhibit movement of said flow control means from said closed position, said tamper-indicating member having a peripheral margin crossing over each one of said flow control means side edge portions, said peripheral margin crossing one of said side edge portions of said flow control means at two spaced-apart locations and said peripheral margin crossing the other of said side edge portions of said flow control means at two spaced-apart locations, each said frangible web in said tamper-indicating member extending continuously along one of said flow control means side edge portions between said two spaced-apart locations and terminating at said two spaced-apart locations, said member further including a graspable pull tab means on said middle section for being pulled to tear said middle section away from said outer sections along said frangible webs to expose said indicium while said outer sections remain attached to said body for extending over said body surfaces and to thereby permit the opening of said lid and provide evidence of tampering with said closure.

16. The closure in according with claim 15 in which said tamper-indicating member defines an inwardly notched configuration in said peripheral margin at each said spaced-apart location where the peripheral margin crosses over one of said lid side edge portions.

17. The closure in accordance with claim 16 in which each said notched configuration in said tamper-indicating member peripheral margin includes a straight edge and a curved edge merging with said straight edge.

18. The closure in accordance with claim 17 in which said curved edge merges with said straight edge of each said notched configuration at a point that is substantially in registry with one of said flow control means side edge portions.

19. The closure in accordance with claim 17 in which said curved edge and said straight edge of each said notched configuration in said tamper-indicating member are defined by a part of the boundary of said middle section and a part of the boundary of one of said outer sections, respectively.

20. The closure in accordance with claim 19 in which said curved edge of each said notched configuration is outwardly convex relative to said middle section which defines it.

21. The closure in accordance with claim 15 in which said flow control means is a pivotable nozzle assembly.

22. The closure in accordance with claim 15 in which said flow control means is a lid hinged to said body.

23. A tamper-evident dispensing closure comprising:

a body suitable for mounting on a container and defining two spaced-apart top surfaces and a dispensing orifice between said top surfaces for communicating with said container for dispensing the contents thereof;

a flow control means disposed on said body between said two spaced-apart top surfaces for being moved between positions opening and closing said dispensing orifice, said flow control means defining an indicium facing outwardly when said flow control means is in the closed position; and a tamper-indicating member over said flow control means and body, said member having two spaced-apart outer sections which are each separate from, but extend over and are attached to, a different one of said body top surfaces, and tamper-indicating member having a middle section extending across and over said flow control means to cover said indicium, said member including an outer frangible web on each side of said middle section for joining said middle section on each side to one of said two outer sections to inhibit movement of said flow control means from said closed position, said member further including a graspable pull tab on said middle section whereby said tab can be pulled to tear said middle section away from said outer sections along said frangible webs to expose said indicium while said outer sections remain attached to said body for extending over said body top surfaces and to permit the opening of said flow control means and provide evidence of tampering with said closure, said tab having a peripheral portion that is unattached to said middle section of said tamper-indicating member except at one end where a connecting portion is attached to said middle section, said middle section further defining an inner frangible web that extends from said tab connecting portion and that has at least a first segment extending generally along, but spaced inwardly of, one of said outer frangible webs.

24. The closure in accordance with claim 23 in which said tamper-indicating member middle section has an exterior edge extending between said outer frangible webs and in which said inner frangible web has a second segment extending generally along, but spaced inwardly of, said exterior edge.

25. The closure in accordance with claim 24 in which said inner frangible web has a third segment extending generally along, but spaced inwardly of, the other one of said outer frangible webs.

26. The closure in accordance with claim 24 in which said tab includes a portion extending outwardly over one of said outer sections of said tamper-indicating member.

27. The closure in accordance with claim 23 in which said flow control means is a pivotable nozzle assembly.

28. The closure in accordance with claim 23 in which said flow control means is a lid hinged to said closure body.

29. A tamper-evident dispensing closure comprising:

a body suitable for mounting on a container and defining two spaced-apart top surfaces and a dispensing orifice between said top surfaces for communicating with said container for dispensing the contents thereof;

a flow control means having an upper surface and disposed on said body between said two spaced-apart top surfaces for being moved between positions opening and closing dispensing orifice; and a tamper-indicating member over said flow control means and body, said member having two spaced-apart outer sections which are each separate from, but attached to, a different one of said body top surfaces, and tamper-indicating member having a middle section extending across and over said flow control means, said member including a frangible web on each side of said middle section for joining said middle section on each side to one of said two outer sections to inhibit movement of said flow control means from said closed position, said member further including graspable pull tab means on said middle section for being pulled to tear said middle section away from said outer sections along said frangible webs to thereby permit the opening of said flow control means and provide evidence of tampering with said closure, said flow control means upper surface defining (1) a normally exposed outermost surface, (2) a first recess for receiving a portion of said middle section, and (3) a second recess that is adjacent said first recess, said second recess being shallower than said first recess to provide a shoulder adjacent said first recess, said tab means being disposed on said shoulder to project beyond said outermost surface.

30. The closure in accordance with claim 29 in which said body top surfaces define recesses for receiving said outer sections of said tamper-indicating member.

31. A tamper-evident dispensing closure comprising:

a body suitable for mounting on a container and defining two spaced-apart top surfaces and a dispensing orifice between said top surfaces for communicating with said container for dispensing the contents thereof;

a flow control means disposed on said body between said two spaced-apart top surfaces for being moved between positions opening and closing said dispensing orifice; and a tamper-indicating member over said flow control means and body, said member having two spaced-apart outer sections each attached to a different one of said body top surfaces and having a middle section extending across and over said flow control means, said member including a frangible web on each side of said middle section for joining said middle section on each side to one of said two outer sections to inhibit movement of said flow control means from said closed position, said member further including graspable pull tab means on said middle section for being pulled to tear said middle section away from said outer sections along said frangible webs and thereby permit the opening of said flow control means and providing evidence of tampering with said closure, said flow control means being pivotally mounted to said body, said flow control means defining a recessed surface for receiving said middle section of said tamper-indicating member, and said flow control means defining an upwardly open retention cavity, and said middle section of said tamper-indicating member including a downwardly projecting post received in said said retention cavity in an interference fit so as to increase the resistance of said middle section to removal from said lid.

32. The closure in accordance with claim 31 in which said retention cavity is a bore in said flow control means; and said post is a cylindrical member.

33. The closure in accordance with claim 32 in which at least one of said post and flow control means is resilient to accommodate insertion of said post into said retention cavity.

* * * * *